United States Patent [19]

Hetrick

[11] 4,157,150

[45] Jun. 5, 1979

[54] HOPPER DEVICE FOR MATERIAL SPREADER HAVING A MULTIPOSITIONABLE COVER

[75] Inventor: Vernon L. Hetrick, Fairview Park, Ohio

[73] Assignee: Meyer Products, Inc., Cleveland, Ohio

[21] Appl. No.: 855,541

[22] Filed: Nov. 29, 1977

[51] Int. Cl.[2] ..... B67D 5/06

[52] U.S. Cl. ..... 222/626; 198/670; 414/526; 222/413

[58] Field of Search ..... 222/148, 317, 328, 413, 222/608, 626; 239/657, 675, 676; 214/83.32, 519; 198/616, 670, 671

[56] References Cited

U.S. PATENT DOCUMENTS

| | | | |
|---|---|---|---|
| 3,189,355 | 6/1965 | Swenson et al. | 239/657 |
| 3,349,970 | 10/1967 | Daneman | 222/236 X |
| 3,438,585 | 4/1969 | Buchmann | 239/665 |
| 3,510,066 | 5/1970 | Swenson | 239/657 |

*Primary Examiner*—Stanley H. Tollberg

*Assistant Examiner*—Fred A. Silverberg

*Attorney, Agent, or Firm*—Meyer, Tilberry & Body

[57] ABSTRACT

A hopper device for mounting transversely across the material discharge end of a vehicle mounted dump bed adapted to contain particulate material to be spread over a roadway being travelled by the vehicle. This type of hopper includes fixed first and second spaced end walls, a fixed back wall between the end walls and an elongated auger extending between the end walls, and an arrangement for rotating the auger about an axis to move material through the hopper toward one end of the hopper. The hopper includes a cover member extending between the end walls and movable between a spreading position where the material can dump into the hopper and be spread from the hopper, a dumping position where the material can be dumped over the hopper and a cleaning position where access is possible to the auger for cleaning by a water hose. The cover member is mounted on links that coact with the end plates to hold the cover plate in each of the three independent positions without losing control of the movement of the cover member between these positions.

19 Claims, 7 Drawing Figures

HOPPER DEVICE FOR MATERIAL SPREADER HAVING A MULTIPOSITIONABLE COVER

This invention relates to the art of spreading material, such as salt or gravel, on roadways and more particularly to an improved hopper for use on a vehicle employed in spreading material on a roadway.

The invention is particularly applicable for use on a vehicle for spreading salt on a roadway during the winter season and will be described with particular reference thereto; however, it is appreciated that the invention has broader applications and can be used for vehicles spreading various materials along a roadway or path being travelled by the vehicle.

BACKGROUND OF THE INVENTION

For many years salt has been spread along a roadway during the winter season to remove ice and reduce the tendency for skidding by vehicles travelling along the roadway. In more recent years, the salt has been spread by a rotating spreader which centrifugally discharges salt dropped on the spreader from a dump bed carried by a truck or other vehicle moving along the roadway. The most successful devices of this nature have involved an elongated hopper extending along the discharge end of the dump bed and including a lower rotating auger which moves the salt toward one end of the hopper. At this end, there is a discharge opening which discharges or drops salt from the hopper onto the spinning broadcast spreader. This general combination is now widely used in spreading salt along a roadway. Such a hopper is very beneficial during use as a spreader; however, if the truck is to be used to dump salt or other material directly onto the roadway in a wide path the hopper has to be removed. To overcome this difficulty, it was proposed that the hopper include a movable cover plate, as shown in Swenson U.S. Pat. No. 3,189,355. The cover plate is moved into a vertical position for spreading and is then shifted to a horizontal position to allow dumping of material over the hopper. Although the structure of this patent is not commonly used, the concept of providing a cover having a vertical position for spreading and a horizontal position for dumping is quite common in salt spreaders. Other patents showing this feature are Daneman U.S. Pat. No. 3,349,970 and Buchmann U.S. Pat. No. 3,438,585. Although a movable cover which could be moved between a dumping position and a spreading position was widely used, this type of structure still presented serious difficulties. Salt being spread would often clog in the auger, especially if it became damp or was allowed to sit for a prolonged time in the hopper. Consequently, it had been proposed that the hopper be provided with a means for allowing access to the auger for cleaning. Such an arrangement is shown in Swenson U.S. Pat. No. 3,510,066. In this patent, the rear wall of the hopper is pivotally mounted so that it may be dropped for cleaning access to the auger extending longitudinally along the lower portion of the hopper. This type of structure allows cleaning by a water hose, etc. and utilizes a movable upper cover shiftable between two positions and a removable rear wall for cleaning. These patents discussed herein are incorporated for reference for the purpose of background information.

THE INVENTION

The present invention relates to an improvement in the hoppers as disclosed in the prior patents mentioned above and similar structures now available which improvement provides a single cover which is movable between three positions allowing dumping, spreading and cleaning. In accordance with the present invention, the single cover is mounted on a link arrangement which allows it to move between the three separate and distinct positions without losing control over the cover member. In addition, rigid locking of the cover is possible in at least the dumping and spreading positions. Consequently, a sturdy structure is provided in these two operating and weight absorbing positions.

In accordance with the present invention, there is provided a hopper of the type described above which includes first and second links each having first and second ends. Means are provided for pivotally mounting the first end of the first link on one end wall of the hopper for pivotal movement about an axis fixed on the hopper and means for pivotally mounting the first end of the second link on the second end wall for pivotal movement around the same axis. The cover member is formed from a generally flat plate extending between the two spaced end walls and an integral closure member extending angularly from the flat plate and generally coextensive therewith. Means are provided for pivotally mounting the cover member on the second ends of the two links for pivotal movement about a second axis which moves with the links and is parallel to the first mentioned axis. First locking means are provided for releasably securing the cover member in the first position with the flat plate defining a front wall for the hopper and the closure member closing the lower portion of the hopper below the auger. This closure member includes a material discharge opening carried by the cover member for forming the discharge opening for the hopper to be used during the spreading operation. There is provided a second locking means for securing the cover in the second position with the flat plate extending over the auger from the discharge end of the dump bed to allow dumping of the material over the hopper and onto the roadway being traversed by the vehicle onto which the hopper is connected.

The primary object of the invention is the provision of a hopper device of the type carried by a vehicle and for use in spreading material from a dump bed on the vehicle onto a roadway along which the vehicle travels, which hopper device can be easily connected to standard vehicles, is somewhat inexpensive to produce, and can be easily maintained.

Another object of the present invention is the provision of a hopper device as defined above, which hopper device provides a single cover selectively movable between spreading, dumping and cleaning positions.

Still a further object of the present invention is the provision of a hopper device as defined above, which hopper device provides cleaning access to both the side and bottom of an auger rotatably mounted within the hopper.

Another object of the present invention is the provision of a hopper device as defined above, which hopper device provides a movable cover member which is supported on spaced links to control manual movement of the cover member between spreading, dumping and cleaning positions.

These and other objects and advantages will become apparent from the following description taken together with the accompanying drawings which are described below.

BRIEF DESCRIPTION OF DRAWINGS

Referring now to the drawings.

PREFERRED EMBODIMENT

Figure 1:
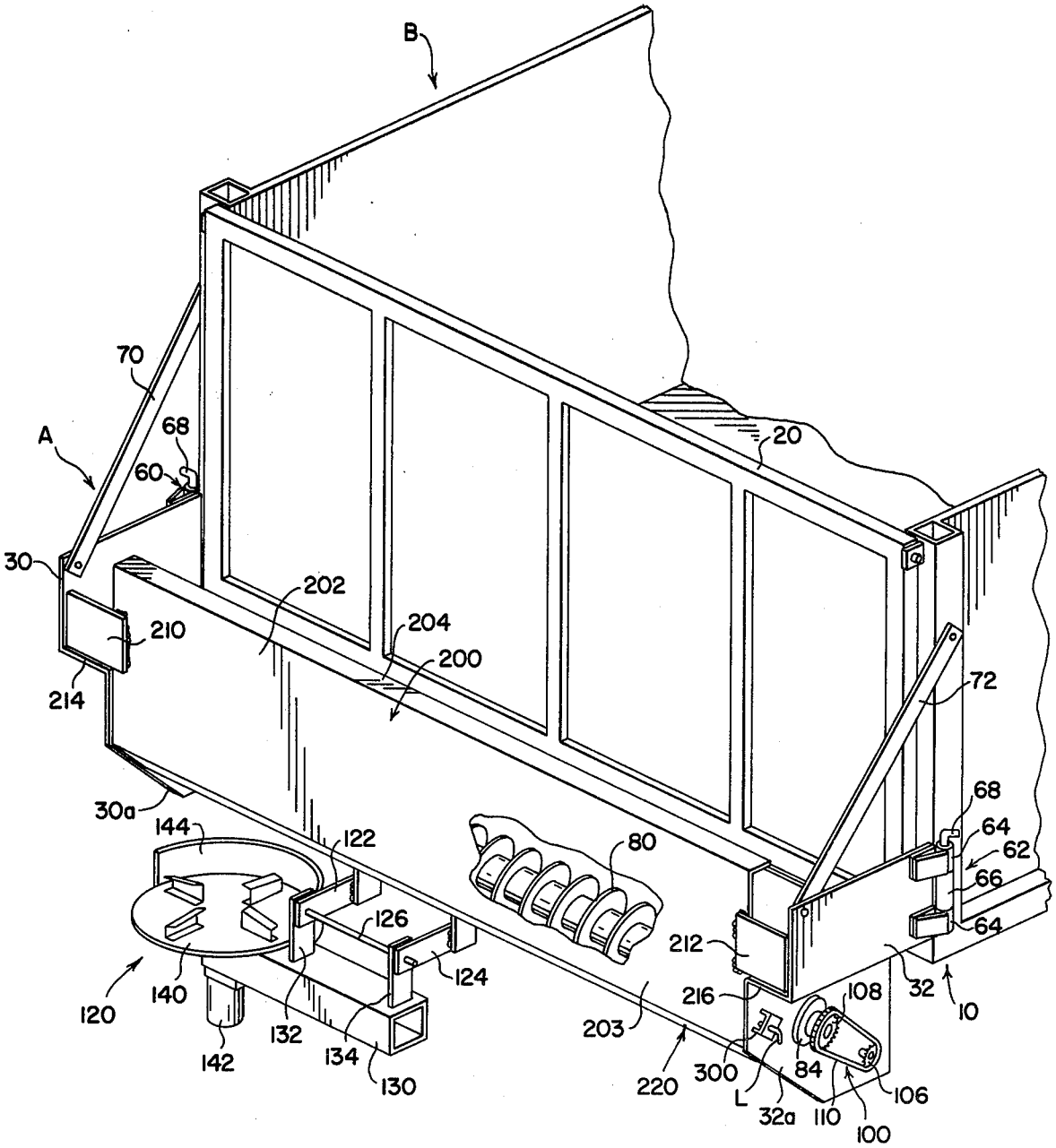
FIG. 1 is a pictorial view showing somewhat schematically the preferred embodiment of the invention and its connection onto the rear of a partially illustrated dump bed.
Figure 3:
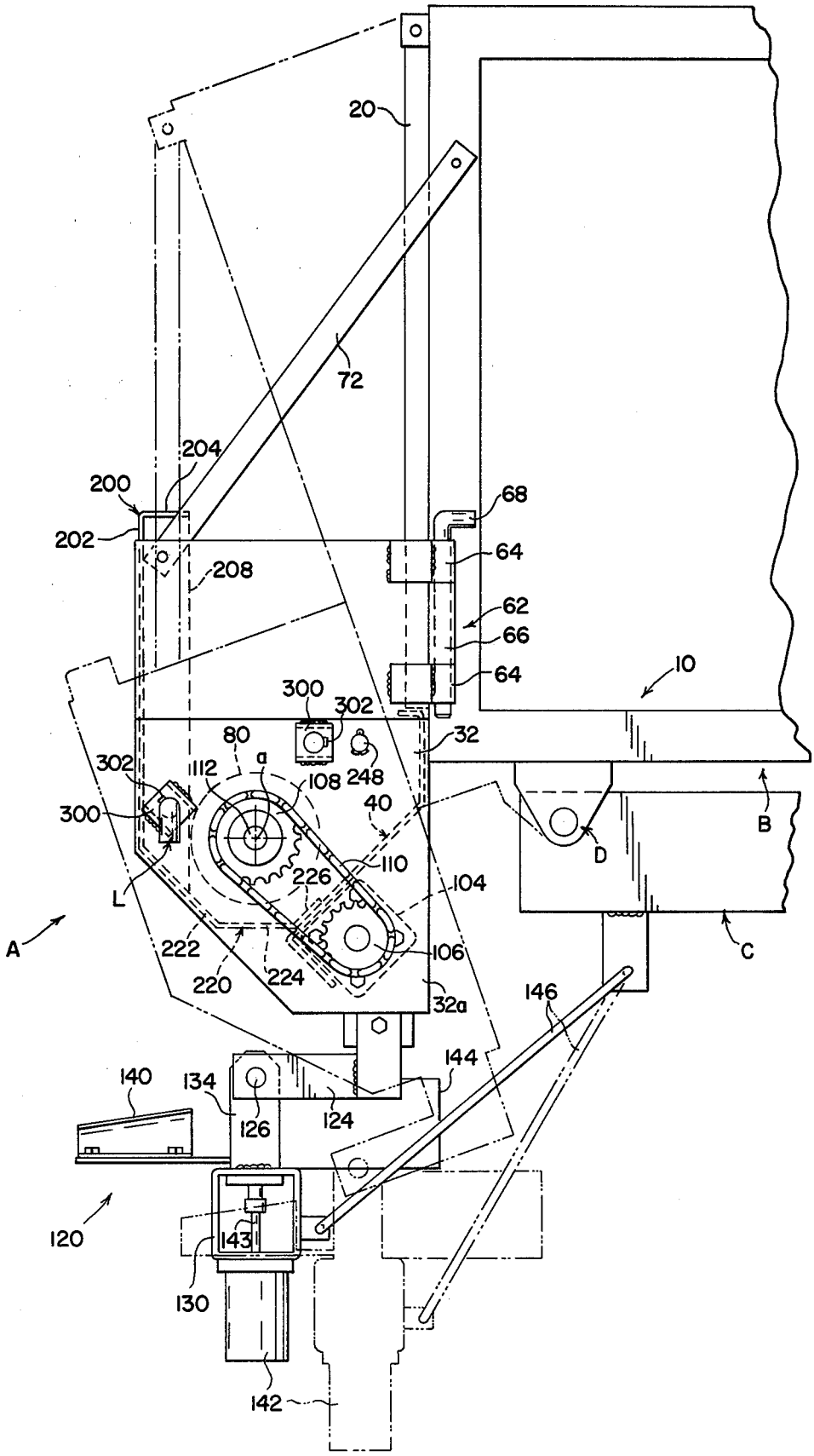
FIG. 3 is a side view of the preferred embodiment of the invention as illustrated in FIGS. 1 and 2 and showing in phantom the tilting position of the hopper member as the vehicle bed is tilted to discharge material into the hopper.

Referring now to the drawings wherein the showings are for the purpose of illustrating a preferred embodiment of the invention only and not for the purpose of limiting same, FIG. 1 shows a hopper A constructed in accordance with the present invention and secured onto the material discharge end 10 of a dump body B attached to a vehicle, such as a truck, adapted to ride along a roadway and spread or dump material from the bed onto the roadway. As best shown in FIG. 3, dump bed B is tiltable on a generally fixed vehicle frame C about a pivot trunnion D. Upon pivotal movement, tailgate 20 pivots about its upper edge to dump material from dump body or bed B into or over hopper A in accordance with standard practice.

Figure 2:
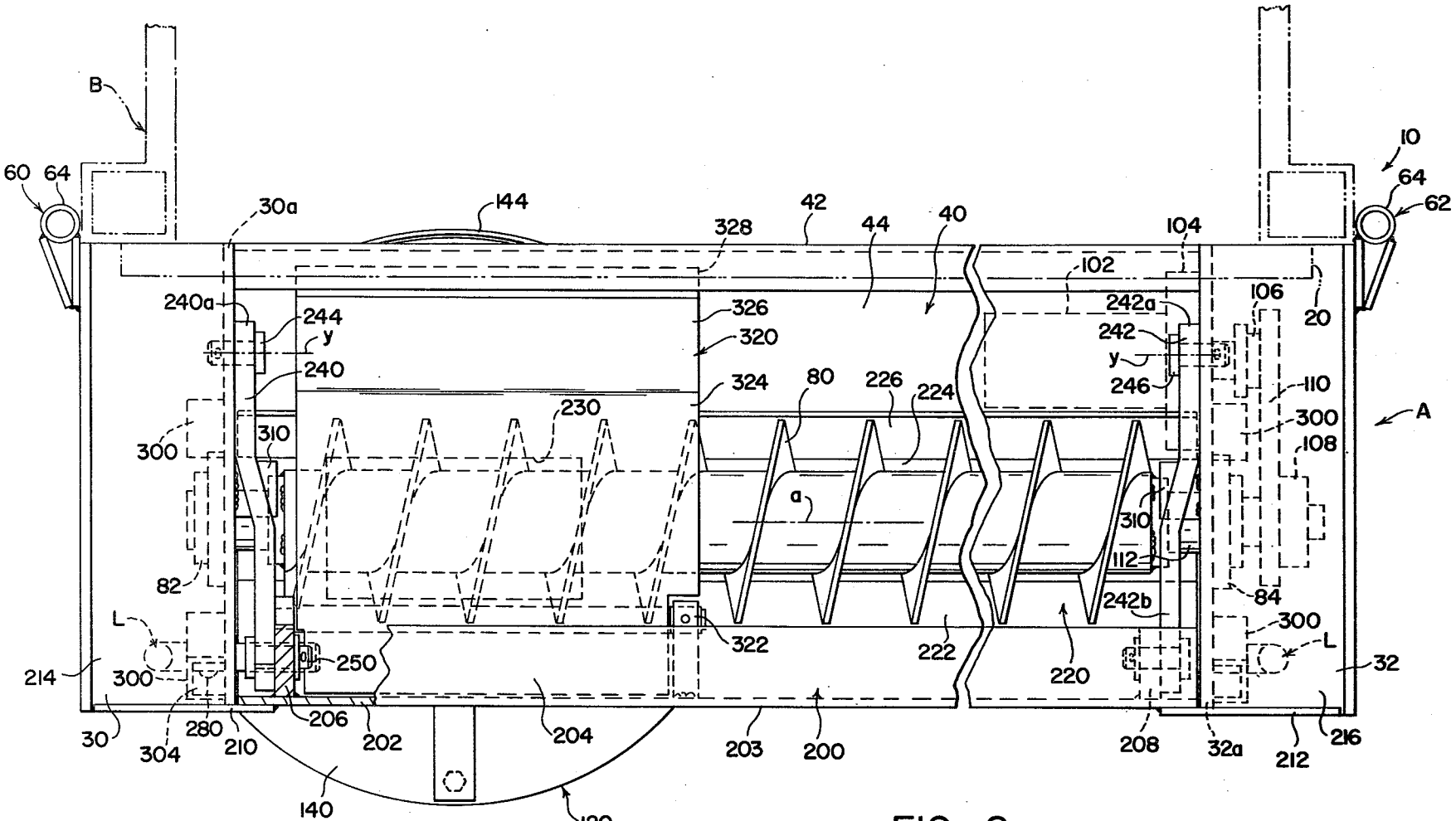
FIG. 2 is a top elevational view with a cut away portion to show both end structures and illustrating the preferred embodiment of the present invention.

Referring now more particularly to the details of hopper A, the hopper includes a relatively rigid fixed structure portion including spaced end plates 30, 32 formed from vertical plate portions 30*a*, 32*a* between which there is fixedly secured a back plate 40 formed into a vertical wall 42, an angled wall 44 and a deflector wall 46. In the preferred embodiment, wall 42, wall 44 and deflector 46 are formed from single sheet metal bent into the shape shown in FIG. 5. To mount the rigid portion of hopper A onto bed B there is provided an appropriate securing structure. In the illustrated embodiment, hinge pin connectors 60, 62 are provided with hopper mounted sleeve 64 and bed mounted sleeves 66. An L-shaped pin 68 extends through the sleeves to secure each end of hopper A onto bed or body B. Struts 70, 72 extend from the bed to end plates 30, 32, as best shown in FIG. 1. As shown in FIG. 2, as bed or dump body B is pivoted about trunnions D, hopper A is tilted into the phantom line position to accept material from bed B. Referring now more particularly to FIGS. 2–5, auger 80 is supported between spaced journals 82, 84 secured in end plates 30, 32, respectively. Auger 80 rotates about axis a to drive material in the hopper from right to left when the hopper is being used for spreading material, in a manner to be described later. Any appropriate mechanism can be used for rotating the auger; however, in the illustrated embodiment mechanism 100 includes an appropriately driven hydraulic motor 102 secured onto end plate 32 by mounting plate 104. This motor drives sprocket 106 connected in a driving fashion with sprocket 108 by an interconnecting chain 110. Sprocket 108 includes a shaft 112 drivingly connected to the auger for rotating the auger in the manner similar to standard hoppers used for spreading salt onto a roadway. In accordance with still a further somewhat standard structure there is provided a lower broadcast spreader 120 mounted onto rigid arms 122, 124 fixed to back plate 40. A pivot shaft 126 supports frame 130 by rocker brackets 132, 134. A spreader wheel 140 is rotated by a hydraulic motor 142 through a shaft 143 for spreading material dropped onto the wheel in accordance with normal practice. A rearward facing rim 144 extends circumferentially around a portion of wheel 140 and is fixed with respect to frame 130 to prevent discharge of material toward the vehicle bed or body B. A stabilizer 146 maintains spreader 120 in a generally vertical position as bed B is tilted in a manner illustrated in FIG. 3.

As so far described, this structure does not differ substantially from known arrangements for spreading salt or other particulate material onto a roadway being traversed by a vehicle carrying dump bed or body B. In accordance with known practice, hopper A is provided with an arrangement for allowing spreading by spreader 120, dumping over the hopper onto the roadway from bed B and cleaning of auger 80. The present invention relates to an arrangement for accomplishing this selective conversion of hopper A in an efficient, structurally rigid manner.

Figure 4:
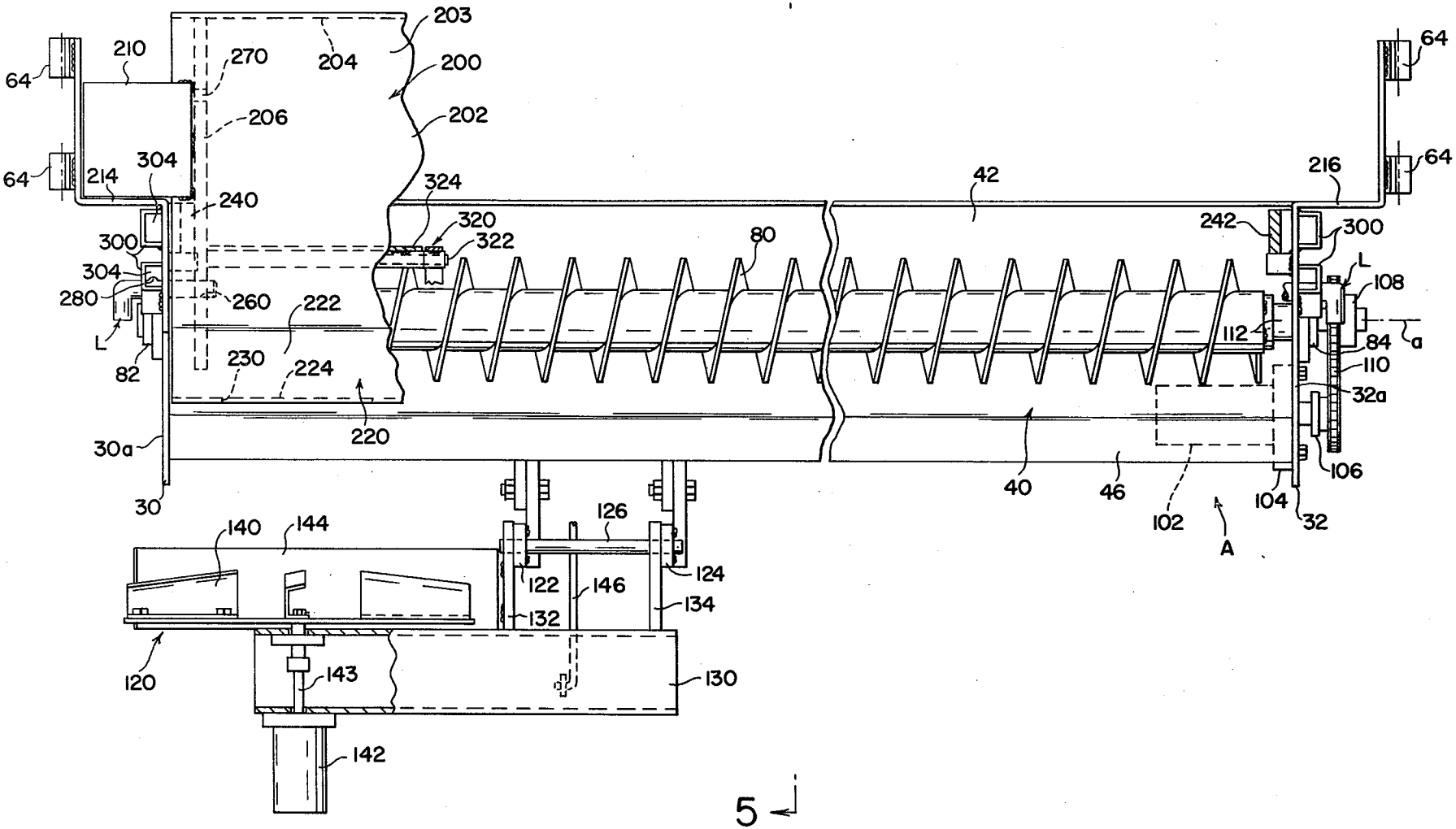
FIG. 4 is a front elevational view generally similar to FIGS. 2 and 3.

In accordance with the present invention, a cover member 200 is provided. Although this cover member may have various structural configurations, in the preferred embodiment an upper wall member or plate 202 includes an upper surface 203 having generally parallel edges which are generally parallel to axis of auger 80. Cover member 200 will be described in the spreading position as shown in FIGS. 1–5. As best illustrated in FIG. 4, upper plate 202 includes end support means to carry the weight of the plate when it is in the spreading position. In the preferred embodiment, the support means include outwardly extending plates 210, 212 adapted to extend over ledges 214, 216 formed in end plates 30, 32, respectively. These plates coact with the ledges to support cover 200 in a vertical direction and also prevent material from discharging around the ends of upper plate 202.

Figure 5:
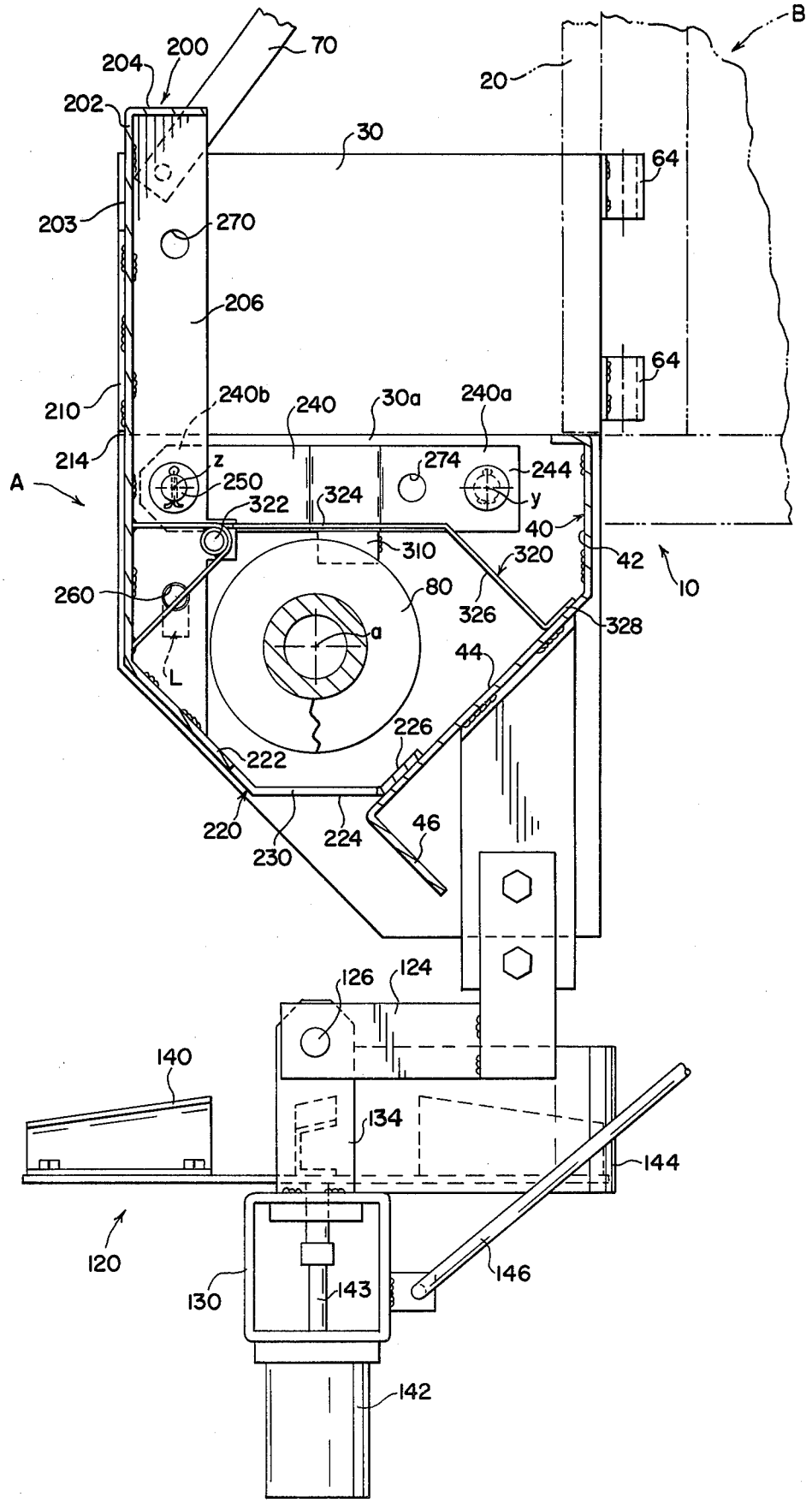
FIG. 5 is a cross sectional view taken generally along line 5—5 of FIG. 4 and showing the novel hopper with the cover member in the dumping position as also shown in FIGS. 1–4.

A closure member or wall 220 is formed integrally with metal plate 202 and angles away from upper surface 203 to form a lower portion of the hopper chamber when cover member 200 is in the spreading position as shown in FIG. 5. Closure member or wall 220 has a sloped portion 222 terminating in a bottom closure wall 224 which includes an upwardly extending stop rim 226. Consequently, when cover member 220 is in the position shown in FIG. 5, elongated stop rim 226 rests against the angled wall 44 of back wall 40. Consequently, angled wall 44 coacts with rim 226 to provide a locator and a vertical support for the closure member or wall 220 of cover member 200 when it is in the spreading position. Links 240, 242 have first ends 240*a*, 242*a*, respectively, pivoted onto end plates 30, 32 about axis y on pins 244, 246, respectively. Axis y is fixed and links 240, 242 pivoted in unison about this axis to control movement of closure member 200 which is fixed to the second ends 240*b*, 242*b* of links 240, 242, respectively. Pins 250, 252 join the second ends of the links onto the transversely extending beams 206, 208, respectively secured to the lower portion of upper plate 202. The rim 204 formed integrally with plate 202 also forms a securing element for transverse beams 206, 208. This provides rigidity to the cover member 200.

Figure 6:
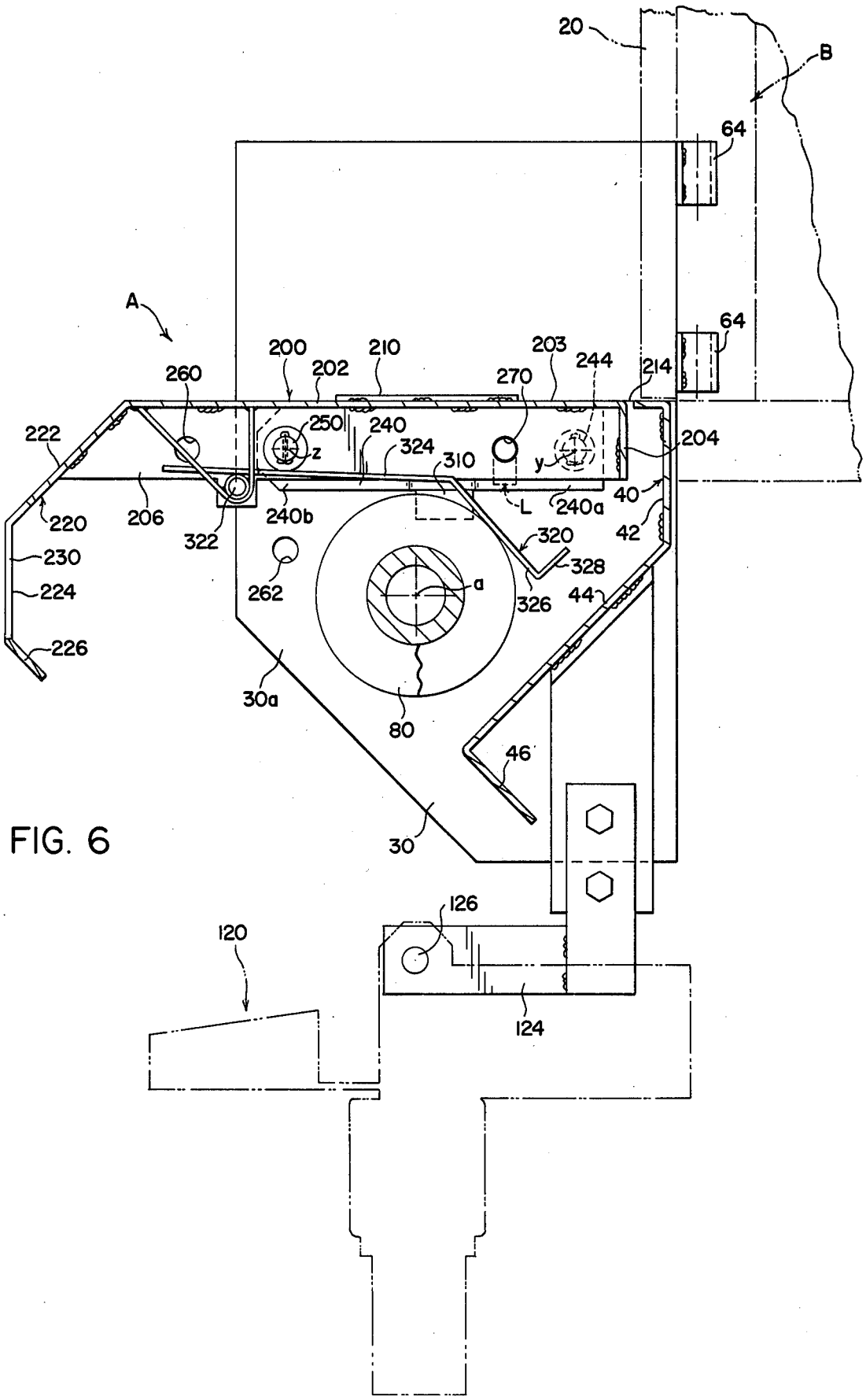
FIG. 6 is a view similar to FIG. 5 showing the cover member in the dumping position; and, FIG. 7 is a view similar to FIG. 5 showing the cover member in the cleaning position.
Figure 7:
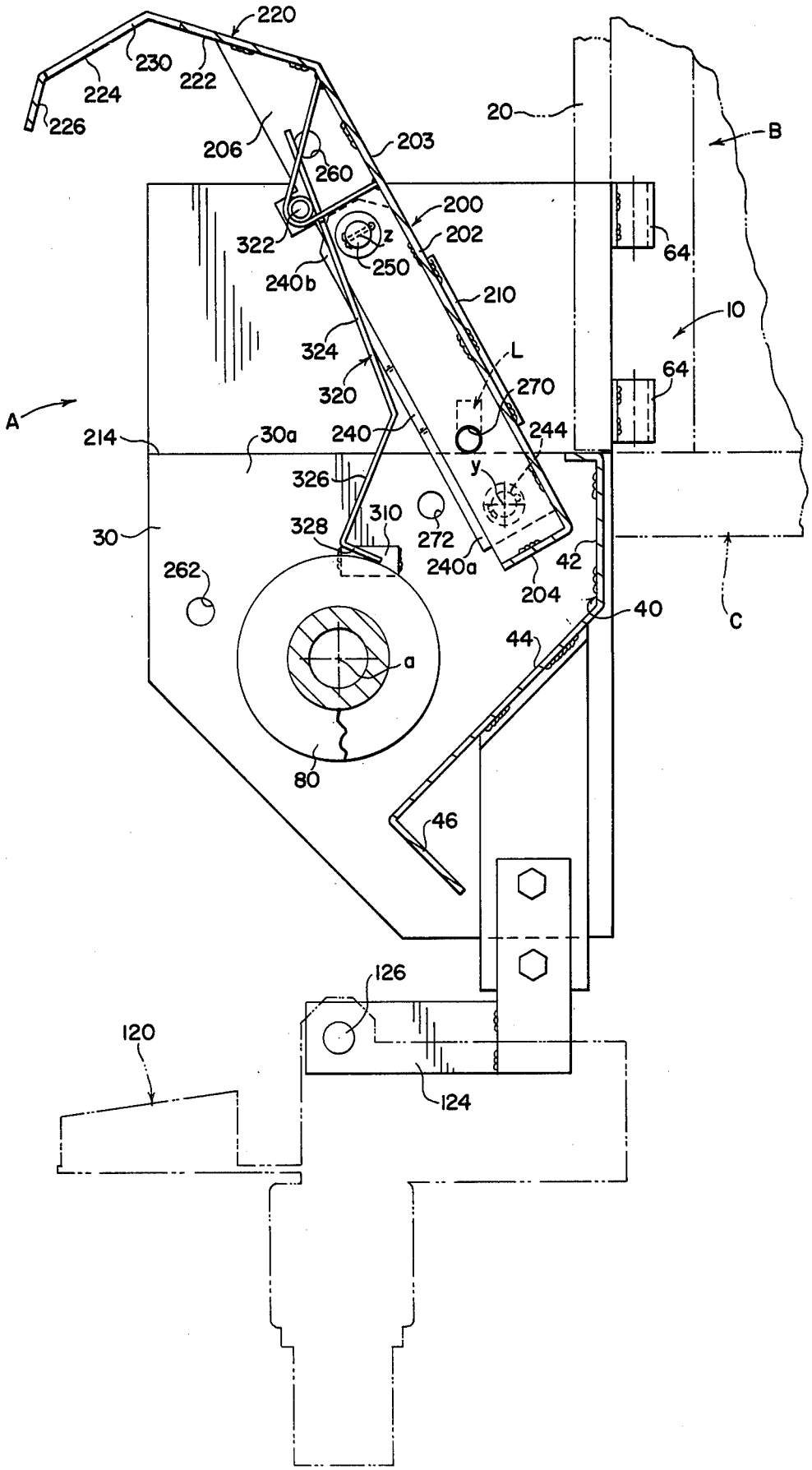

As shown in FIGS. 5–7, the front end of beam 206 is provided with a locator hole 260. A similar hole 260 is provided in a like position on beam 208. In a similar fashion, a locator hole 262 is provided in the vertical plates 30*a*, 32*a* of spaced end plates 30, 32, respectively. At the rear end of beam 206 there is provided a locating hole 270. A like positioned locator hole 270 is provided in beam 208. As best shown in FIG. 7, a locator hole 272 is provided in end plate position 30*a*. A corresponding hole 272 is provided in end plate position 32*a*. As best shown in FIG. 5, each of the links includes a locator hole 274. In the dumping position shown in FIG. 6, locator holes 270 on the beams, holes 272 on the end plates and holes 274 on the links are aligned. In the other position, various other locator holes are aligned in a manner to be described later. When the locator holes are aligned, they may be locked together or latched by an appropriate means indicated as a series of L-shaped, removable pins L, each of which has, in the illustrated embodiment, a crimped key portion 280. As will be explained later, a plurality of upstanding brackets 300 having key openings 302 and inner receptacles 304 are used in conjunction with the lock or latch pins L to hold cover member 200 and the spaced links in the desired manually adjusted position to perform the function desired. The arrangement of the pins and locator holes for securing the cover member and links in the desired positions for spreading, dumping and cleaning will be described with respect to FIGS. 5, 6 and 7, respectively.

Spreading Position

As shown in FIG. 5, cover member 200 is pivoted around axis z defined by pins 250, 252 so that locator holes 260, 262 at each beam 206, 208 are aligned. Stops 310 limit movement of the links and hold them in the horizontal position for final pivoting of cover member 200 into the position shown in FIG. 5. Latch pins L are then inserted through holes 260, 262 at each end of cover member 200. Stop rim 226 rests against the lower portion of angled wall 44 of back wall 40. A discharge opening 230 best shown in FIG. 2 is then aligned above the central portion of spreading wheel 140 of spreader 120. As auger 80 is rotated by motor 102, material from bed B is moved toward opening 230 and is discharged onto the rotating spreader wheel. In this position, the lower edge of links 240, 242 rests upon stops or buttons 310 secured onto each end wall 30, 32 as shown best in FIG. 5 with respect to end wall 30. As can be seen, by the support rim 226, stop 310 and pin L in holes 260, 262, cover member 200 is fixedly secured and held firmly in the spreading position of FIG. 5 for discharge of material through opening 230 onto rotating spreader 120. Transversely spaced plates 210, 212 also vertically support cover member 200 in the position shown in FIG. 5.

Dumping Position

Referring now to FIG. 6, cover member 200 is positioned in the dumping position allowing discharge of material over surface 203 of plate 202 which is generally aligned with the lower wall of dumping bed B. In this position, cover member 200 is pivoted around axis z until locator holes 270, 272 and 274 all align. The links remain on stops or supports 310. In this manner, a lock or latch pin L can be passed through the end plates, links and transverse beams to hold the position of member 200 illustrated in FIG. 6. Also, outwardly extending end plates 210, 212 override ledges 214, 216 to provide additional support for member 200 in the dumping position. Again, links 240, 242 rest upon stops 310 at each end plate 30, 32. This multiple support arrangement for cover member 200 rigidifies the cover member in the dumping position as shown in FIG. 6. Plates 210, 212 assist in providing location of the cover member in the dumping position as they do in providing location of the cover member in the spreading position shown in FIG. 5.

Cleaning Position

In the cleaning position, as shown in FIG. 7, locator pin L is secured through locator openings 270 and 274. The locator pin then rests upon ledge 214 to hold the position of member 200 as shown in FIG. 7. Of course, the member can be pivoted upwardly away from ledges 214, 216 since the link and cover member now are movable in unison. However, the cover member can not move downwardly beyond a position shown in FIG. 7 to inadvertently drop during the cleaning operation. In this position, auger 80 is exposed for cleaning by an appropriate device, such as a water hose or manual scraper. In addition, the lower portion of the hopper is opened so that water can drain from the auger cleaning operation. Still further, back wall 40 can be cleaned with a hose since the lower wall of the hopper has been removed in that it is carried by the cover member 200.

Auger Cover Plate

In accordance with normal practice, an auger cover plate is generally provided over auger 80 and extending axially outwardly from both ends of the discharge opening 230. This is generally a permanent structure which prevents direct discharge of material through opening 230 by the dumping action of bed B. In this manner, the auger feeds the material to the opening under the auger cover plate. This type of cover plate causes certain difficulty in cleaning the auger. In accordance with another aspect of the present invention there is provided a novel auger cover plate 320 which is supported onto movable cover member 200 by hinged support 322. The cover plate includes an upper plate portion 324 terminating in an angularly positioned free end portion 326 having a stop ledge or rim 328. In accordance with the illustrated embodiment of the invention, auger cover plate 320 rests upon sloped wall 44 of back wall 40 when the cover plate is in the spreading position, as shown in FIG. 5. This is normal operating position for the cover plate. In the other positions of cover member 200 cover plate 320 is not required. Thus, as the cover member is moved into the dumping position shown in FIG. 6, free end 326 rides on the outer surface of auger 80. As cover member 200 is moved into the cleaning position, free end 326 remains above the auger as shown in FIG. 7. However, in the illustrated embodiment the stop rim 328 rests upon the upper surface of the auger. It is contemplated that the auger cover plate is limited in movement by the auger so that it does not need to be manually manipulated as the cover member is changed from the various positions. Of course, an appropriate stop could be provided on the hinged support 322 or another position to assure that the free end of the auger cover plate does not extend over the auger in a manner which would require manual manipulation. However, if manual manipulation is not considered to be a major concern, plate 320 can be pushed rearwardly as cover member 200 is moved into either the spreading position or the dumping position from the cleaning position.

Having thus described the invention, it is claimed:

1. In a hopper device for mounting transversely across the material discharge end of a vehicle mounted dump bed adapted to contain particulate material to be spread over a roadway being travelled by said vehicle, said hopper device including fixed first and second spaced end walls, a fixed back wall connected to said end walls, an elongated auger extending between said end walls, means for rotating said auger about an axis generally parallel to said back wall for conveying said material toward said first end wall, and a cover member extending between said end walls, said cover member being movable between a first spreading position forming a front wall for said hopper, a second dumping position forming a top wall for said hopper, and a third cleaning position exposing said auger, the improvement comprising: said cover member including a first wall member having an outwardly facing surface defining first and second generally parallel edges extending between said end walls and a second wall member fixed to said first wall member at an angle extending away from said outwardly facing surface and adjacent said first edge; at least one link having first and second ends; means for pivotally connecting said first end of said link to said cover on an axis movable with said cover, between said edges and generally parallel to said auger axis; means for pivotally connecting said second end of said link to an axis generally fixed on said hopper device and parallel to said movable axis adjacent said back wall; first locator means for releasably securing said cover member in said first position with said first wall member generally parallel to said back wall and said second wall forming the bottom of said hopper; second locator means for releasably securing said cover member in said second position with first wall member extending over said auger and from said discharge end for forming an upper cover for said hopper; means for securing said cover member in said third position with said first wall member and said second wall member pivoted away from said auger and generally toward said back wall to form a transverse access opening to said auger; and, means forming a material discharge opening in said second wall member of said cover member adjacent said first end wall.

2. The improvement as defined in claim 1 wherein said first locator means is a pin extending from one of said end walls into an opening in said cover member.

3. The improvement as defined in claim 1 wherein said second locator means is a pin extending from one of said end walls into an opening in said cover member.

4. The improvement as defined in claim 1 including a first opening in said cover member, a second opening in said link and between said ends of said link; said first and second openings being aligned in at least said second position of said cover member and said second locator means including a pin means extending into each of said first and second openings.

5. The improvement as defined in claim 4 including a third opening aligned with said first and second openings when said cover member is in said second position and said pin means extending through said third opening in said second position.

6. The improvement as defined in claim 1 including a stop means for limiting movement of said second wall member toward said back wall when said cover member is in said first position.

7. The improvement as defined in claim 1 including an auger cover plate adjacent said first end and aligned with said material discharge opening, said cover plate having a first position pivotally mounted on said cover member to pivot about an axis generally parallel to said auger axis and a second free end extending over said auger, said plate having a stop means engageable with said back wall for holding said plate spaced above said auger when said cover member is in said first position.

8. The improvement as defined in claim 7 including a stop means for limiting movement of said second wall member toward said back wall when said cover member is in said first position.

9. The improvement as defined in claim 1 including means for stopping movement of said link in a direction toward said auger.

10. In a hopper device for mounting transversely across the material discharge end of a vehicle mounted dump bed adapted to contain particulate material to be spread over a roadway being travelled by said vehicle, said hopper device including fixed first and second spaced end walls, a fixed back wall connected to said end walls, an elongated auger extending between said end walls, means for rotating said auger about an axis generally parallel to said back wall for conveying said material toward said first end wall, and a cover member extending between said end walls, said cover member being movable between a first spreading position forming a front wall for said hopper, a second dumping position forming a top wall for said hopper, and a third cleaning position exposing said auger, the improvement comprising: first and second links each having first and second ends; means for pivotally mounting said first end of said first link on said first end wall for pivotal movement about an axis fixed with respect to said end walls; means for pivotally mounting said first end of said second link on said second end wall for pivotal movement about said fixed axis; said cover member having a generally flat plate extending between said first and second end walls and an integral closure member extending angularly from said plate and generally coextensive therewith; means for pivotally mounting said cover member on the second ends of said links for pivotal movement about an axis movable with said links and parallel to said fixed axis; first locking means for releasably securing said cover member in said first position with said flat plate defining a front wall for said hopper device parallel to said back wall and said closure member closing the lower portion of said hopper device below said auger; second locking means for securing said cover member in said second position with said flat plate extending over said auger and extending from said discharge end of said bed; and means forming a material discharge opening in said closure member adjacent said first end wall.

11. The improvement as defined in claim 10 including means for fixing said cover member with respect to said first and second links when said cover member is in said second position.

12. The improvement as defined in claim 10 including a fixed stop means for engaging and limiting movement of said closure plate toward said back wall when said cover member is in said first position.

13. The improvement as defined in claim 12 including an auger cover plate adjacent said first end and aligned with said material discharge opening, said cover plate having a first position pivotally mounted on said cover member to pivot about an axis generally parallel to said auger axis and a second free end extending over said auger, said plate having a stop means engageable with said back wall for holding said plate spaced above said auger when said cover member is in said first position.

14. The improvement as defined in claim 10 including an auger cover plate adjacent said first end and aligned with said material discharge opening, said cover plate having a first position pivotally mounted on said cover member to pivot about an axis generally parallel to said auger axis and a second free end extending over said auger, said plate having a stop means engageable with said back wall for holding said plate spaced above said auger when said cover member is in said first position.

15. The improvement as defined in claim 10 including means for stopping movement of said links in a direction toward said auger and at a preselected position for said links.

16. The improvement as defined in claim 15 wherein said second locking means includes means for locking said links in said preselected positions.

17. The improvement as defined in claim 16 wherein said support means include first and second axially outwardly extending members and means for supporting said outwardly extending members above corresponding abutment member fixed on said end plates.

18. The improvement as defined in claim 10 including support means on said cover member for vertically supporting said cover member by said end plates when said cover member is in said first position.

19. In a hopper device for mounting transversely across the material discharge end of a vehicle mounted dump bed adapted to contain particulate material to be spread over a roadway being travelled by said vehicle, said hopper device including fixed first and second spaced end walls, a fixed back wall connected to said end walls, an elongated auger extending between said end walls, means for rotating said auger about an axis generally parallel to said back wall for conveying said material toward said first end wall, and a cover member extending between said end walls, said cover member being movable between a first spreading position forming a front wall for said hopper, a second dumping position forming a top wall for said hopper, and a third cleaning position exposing said auger, the improvement comprising: an auger cover plate having a portion pivotally mounted on said cover member to pivot about an axis generally parallel to said auger axis and a free end extending over said auger, said auger cover plate having a stop means engageable with said back wall for holding said plate spaced above said auger when said cover member is in said first position.

* * * * *